United States Patent [19]

Morihashi et al.

[11] 4,445,252

[45] May 1, 1984

[54] DRAFTING APPARATUS IN SPINNING MACHINE

[75] Inventors: Toshifumi Morihashi, Shiga; Koshi Noda, Joyo; Teruo Nakayama; Shinichi Nishimura, both of Shiga; Michiaki Fujiwara, Kameoka, all of Japan

[73] Assignee: Murata Kikai Kabushiki Kaisha, Kyoto, Japan

[21] Appl. No.: 320,871

[22] Filed: Nov. 13, 1981

[30] Foreign Application Priority Data

Nov. 14, 1980 [JP] Japan ..... 55-161291
Oct. 9, 1981 [JP] Japan ..... 56-161868

[51] Int. Cl.[3] ..... D01H 5/72; D01H 5/86
[52] U.S. Cl. ..... 19/244; 19/288
[58] Field of Search ..... 19/244, 252, 253, 256, 19/288, 287, 252

[56] References Cited

U.S. PATENT DOCUMENTS

| | | | |
|---|---|---|---|
| 2,184,717 | 12/1939 | Lee | 19/287 |
| 2,771,639 | 11/1956 | Aymerich | 19/288 |
| 3,133,320 | 5/1964 | Swanson | 19/288 |
| 3,136,006 | 6/1964 | Mackie | 19/252 |
| 3,359,713 | 12/1967 | Keyser | 19/287 |

FOREIGN PATENT DOCUMENTS

| | | | |
|---|---|---|---|
| 658264 | 10/1951 | United Kingdom | 19/252 |

*Primary Examiner*—Louis Rimrodt
*Attorney, Agent, or Firm*—Spensley, Horn, Jubas & Lubitz

[57] ABSTRACT

A drafting device in a spinning machine including a cylindrical sliver guide and an adjusting guide for reshaping and controlling the sliver, and a traverse mechanism for an apron supported on the middle roller. The sliver guide is disposed in front of the back rollers and the adjusting guide is arranged between the back rollers and the middle rollers.

4 Claims, 17 Drawing Figures

FIG. 3
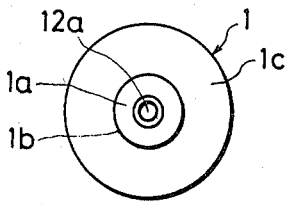
FIG. 4-d
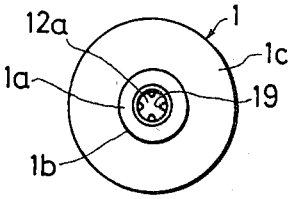
FIG. 4-a
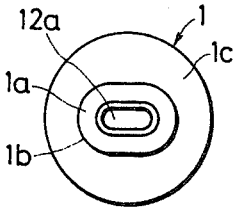
FIG. 4-b
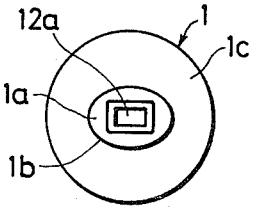
FIG. 4-c
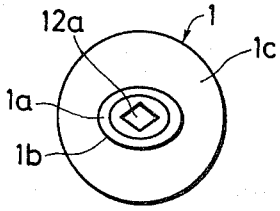
FIG. 5
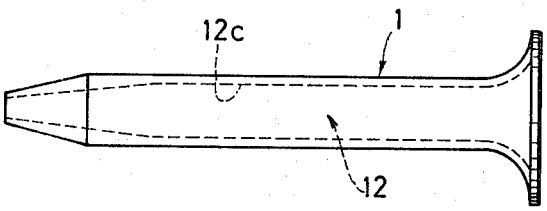
FIG. 6
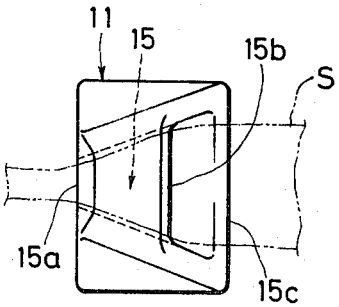
FIG. 7
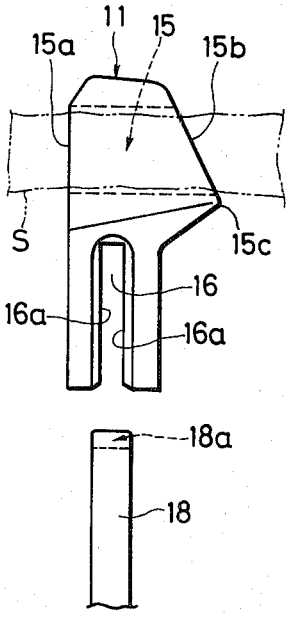

DRAFTING APPARATUS IN SPINNING MACHINE

BACKGROUND OF THE INVENTION

The drafting apparatus is indispensable for a spinning frame. The spinning speed in the spinning frame differs depending on whether the spinning frame is a ring spinning frame or a pneumatic spinning frame. Ordinarily, in the ring spinning process, the spinning speed is 13 to 15 m/min in case of a yarn of a British count of Ne 45, and in the pneumatic spinning process, it is said that a spinning speed of 180 to 200 m/min is attainable in case of the above yarn. In each of these two spinning processes, it is not too much to say that the physical properties, that is, quality, of spun yarns depend mainly on the capacity of the drafting apparatus disposed before the spinning step. In the case of the pneumatic spinning process, since the spinning operation can be performed at a high speed, it is necessary to use a high-draft apparatus adaptable to high-speed spinning or a stepwide drafting apparatus including the roving and spinning steps. Accordingly, influences of the drafting apparatus are very significant.

In this drafting process, when the fed sliver is bent or flattened, uneven drafting takes place regardless of the functional condition of drafting system and, therefore, not only imperfections such as slubs or neps are generated on the yarn but also yarn breakage occurs more frequently, resulting in decrease of operation efficiency of the spinning frame and degradation of the yarn quality. Since the sliver that has undergone drawing process is generally coiled and contained in a cylindrical can, it is liable to be deformed very flat in cross-section and is, in some cases, shaped into a ribbon-like one upon receiving partial twisting when taken out from the can. When such deformed sliver as above is fed between back rollers of the spinning frame, a concurrent action of sliver-flattening by mutual compression of rollers and break draft between the back and middle rollers greatly expands the fiber bundle running between these two roller pairs and, in addition, produces variation in width every time of expanding, which leads to uneven draft.

In the drafting apparatus, a sliver is consecutively drafted by passing it through between pairs of back rollers, middle rollers and front rollers differing in the peripheral speed. Since the draft ratio between the middle rollers and the front roller is several times to scores of times as high as the draft ratio between the back rollers and the middle rollers, aprons are arranged on the middle roller as means for controlling occurrence of uneven drafting.

The aprons attached to the middle rollers are effective for controlling occurrence of uneven drafting and this effect is especially prominent in the high-draft apparatus. However, since a fiber bundle being drafted is passed through between the upper and lower aprons pressed to each other, the fiber bundle-passing surfaces of the aprons are worn by friction, and with advance of wearing of the aprons, the quality of the spun yarn is adversely influenced by wearing of the aprons. Especially in the high-draft apparatus where high-speed spinning is possible, wearing of the aprons is advanced very promptly, and from experiments made by us, it has been confirmed that in case of a fully operation, adverse influences on the physical properties of spun yarns are observed within about 3 to about 4 days in case of aprons formed of some materials and in such case, the worn aprons should be exchanged with new aprons.

The factor having influences on the physical properties of spun yarns is not limited to wearing of the aprons, but they are influenced by the surface roughness of the aprons and other spinning conditions. However, it is construed that the influences of wearing of the aprons are significant.

Exchange of aprons requires the troublesome operation of taking out the shafts of the middle rollers, and these shafts are integrally connected to those of other units, for example, 10 to 15 units. Accordingly, a series of the related units should be stopped for exchanging aprons in one unit, with the result that the productivity is reduced. Consequently, the conventional technique involves problems of early appearance of influences of wearing of aprons on the quality of spun yarns and also of reduction of the productivity of necessity of exchange aprons.

SUMMARY OF THE INVENTION

The present invention relates to a drafting method and device in a spinning machine for preparing spun yarns from tows or slivers. More particularly, the present invention relates to a drafting method and drafting device in a drafting apparatus of a spinning machine, which exerts prominent effects when the method is applied to not only a ring spinning frame but also a high-draft apparatus in which the roving step is omitted and a pneumatic spinning machine constructed by combining such high-draft apparatus with a pneumatic spinning frame, in which the spinning operation is performed by the action of a fluid such as air and the spinning speed can be increased to a level at least 10 times as high as the spinning speed in the ring spinning frame.

An object of the present invention is to provide a drafting device including a sliver guide to reshape the sliver compressed flat while contained in the can and to controll excessive expansion of the fiber bundle by the back rollers.

Another object of the present invention is to provide a drafting method and drafting device in a spinning machine in which lives of aprons can prominently be prolonged.

Still another object of the present invention is to provide a drafting device including a traverse mechanism for an apron.

According to the present invention, the sliver compressed flat while contained in the can can be reasonably reshaped and excessive expansion of the fiber bundle by the back roller pair can be controlled, thereby eliminating uneven drafting and, instead, ensuring satisfactory stable drafting performance. Moreover, since the aprons attached to the middle rollers are traversed so that the advance of the sliver being drafted is not influenced, the sliver is brought into contact with the aprons along the entire transverse width thereof, and wearing of the aprons is remarkably reduced and the lives of the aprons are greatly prolonged. Furthermore, prolongation of the lives of the aprons results in reduction of the frequency of exchange of aprons and the loss time due to stoppage of the machine for exchange of aprons is reduced, with the result that the working efficiency is prominently increased.

BRIEF DESCRIPTION OF DRAWINGS

FIG. 3 is a front view of the sliver guide;

FIGS. 4-*a*, 4-*b*, 4-*c* and 4-*d* are front views of other embodiments of sliver guides;

FIG. 5 is a side view showing another embodiment of the sliver guide.

FIG. 6 is a plan view of an adjusting guide;

FIG. 7 is a side view of the adjusting guide shown in FIG. 6;

DETAILED DESCRIPTION OF THE INVENTION

The present invention will now be described in detail with reference to embodiments illustrated in the accompanying drawings.

Figure 1:
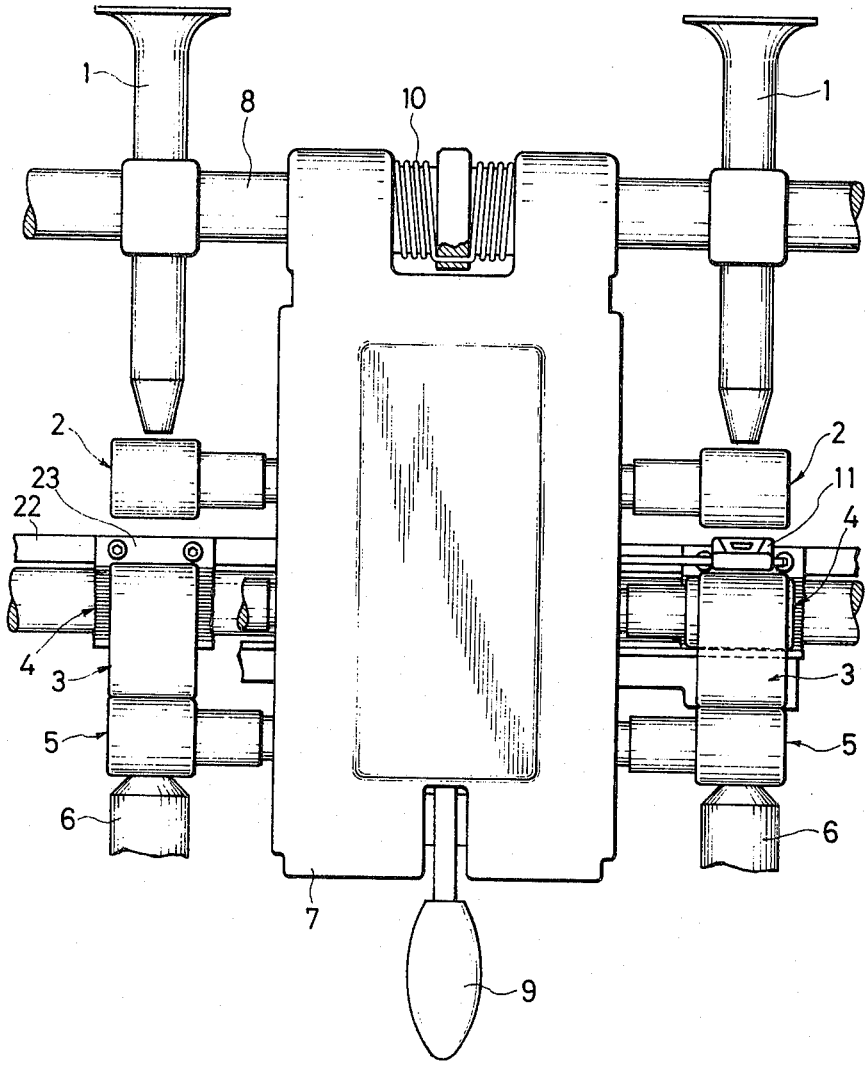
FIG. 1 is a plan view of the drafting apparatus.
Figure 2:
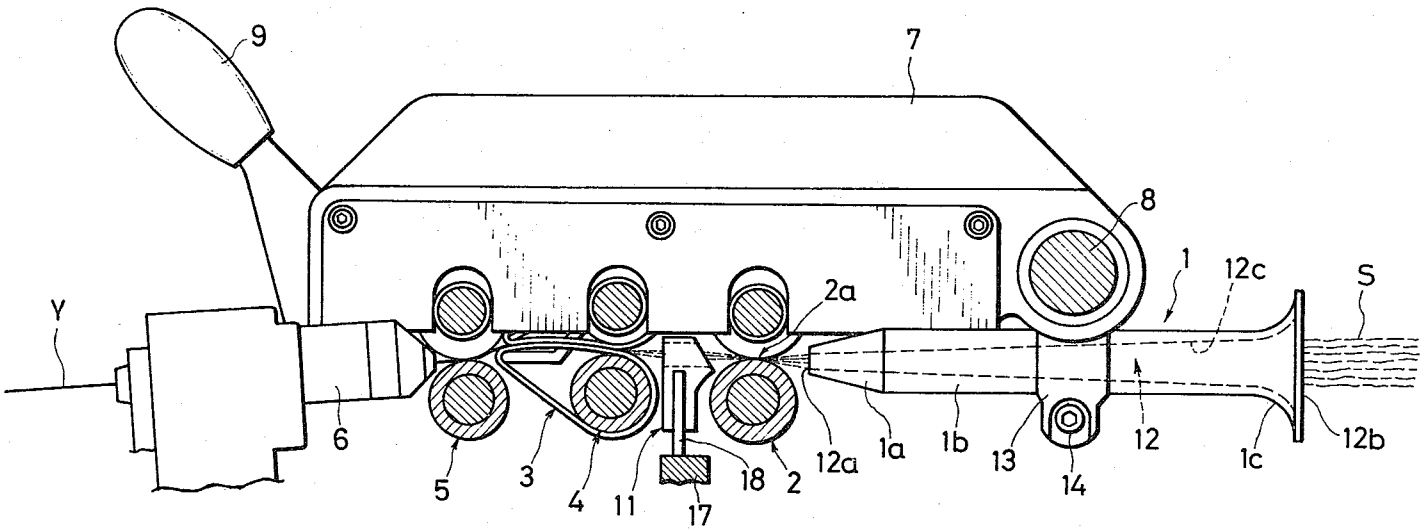
FIG. 2 is a partially cutaway vertical side view of the drafting apparatus of the present invention.

FIGS. 1 and 2 are plan and side views of the drafting apparatus. A sliver 5 taken out from a can (not shown) passes through a sliver guide 1 without passing through the roving step, and is consecutively drafted by passing through pairs of upper and lower back rollers 2, middle rollers 4 and front rollers 5, whereby the sliver S is converted to a fiber bundle corresponding to one yarn. Each pair of the rollers are positively rotated in the state where one end of the periphery of one roller is pressed to one end of the periphery of the other roller. Aprons 3 are attached to the middle rollers 4. The sliver S which has been thus converted to the fiber bundle is fed out and guided into a pneumatic spinning apparatus 6, for example, a pneumatic spinning apparatus in which two jet nozzles rotated in opposite directions by the action of air are arranged, the fed fiber bundle is twisted by one nozzle and ballooning is caused by the other nozzle, whereby a spun yarn Y is formed or a pneumatic spinning apparatus in which the fiber bundle is subjected to the sucking action of one nozzle and ballooning is caused in the fed fiber bundle by the other nozzle, whereby a spun yarn Y is formed. The so-formed spun yarn is positively taken out through a yarn guide (not shown) by take-up rollers and is wound on a package through necessary processings by traverse guides, friction rollers and the like. Thus, a series of operations of the basic spinning process are completed.

The aforesaid rollers 2, 4, and 5 are, as previously described, different from each other in circumferential speed, and speed difference between every two pairs of rollers produces draft whose rate gradually varies at every drafting zone defined by the roller pairs. The reference numeral 7 indicates a top roller support rotatably carried by the shaft 8 and opened or closed with the operation of the locking lever 9, the numeral 10 represents a spring to keep the top roller support 7 open when the support 7 is opened, and the numeral 11 represents an adjusting guide arranged between the back rollers 2 and the middle rollers 4.

Describing in detail the sliver guide 1 referring in FIGS. 2 and 3, it is in the shape of cone at the tip portion 1*a*, of cylinder at the middle portion 1*b*, of trumpet at the base end portion 1*c*, and is internally provided with the sliver passageway 12 as well as carried by the shaft 8 through the setting piece 13 independently from the top roller support 7. The sliver passageway 12 is formed to extend throughout the length of the sliver guide 1, provided with an outlet 12*a* of small diameter at the tip and an inlet 12*b* of large diameter at the base end thereof, and conical inner wall 12 which extends to connect said two parts with each other for providing a smooth passageway. Said inlet 12*b* is given a cross-sectional area sufficiently large enough for receiving any one of slivers ranging from 100 to 500 gr/yd in thickness while the outlet 12*a* is cross-sectionally sized according to grains per yard of the sliver S as follows: 40–20 $mm^2$ for slivers of 100–50 gr/yd and 30–10 $mm^2$ for those of 50–20 gr/yd as a general rule for a good result. The sliver guide 1 is made of plastic material and has a length of about 15 cm, the outlet 12*a* thereof being preferrably located close to the contact line 2*a* of the back rollers 2 as far as possible. Since the setting piece 13 is made up so as to be capable of tightening or loosening the sliver guide 1 with the screw 14 optionally as well as the shaft 8 with another screw not shown, the sliver guide 1 can be set in any position and at any inclination degree without limitation.

Referring to FIGS. 6 and 7, said adjusting guide 11 is a block made of plastic and provided with a silver passageway 15 at the top portion and a setting groove 16 at the bottom portion, being positioned between the back rollers 2 and the middle rollers 4. The sliver passageway 15 running through the adjusting guide 11 along the advance direction of the sliver S is provided with an outlet 15*a* and inlet 15*b* which are roughly equal to each other in height, but the outlet 15*a* is laterally narrower than the inlet 15*b* to form a taper. A plurality of locking ribs 16*a* are formed on the inner wall of the setting groove 16 and setting recess 18*a* is formed on the support plate 18 provided upright on the other stationary block 17, where the adjusting guide 11 is supported in such manner as lying astride the support plate 18 and positioned after fitted into the setting recess 18*a*. Lateral widths of the outlet 15*a* for use are various according to the counts and kind of yarn to be spun and those ranging from 2 to 10 mm are normally used. The inlet 15*b* has a surface tapered when viewed along the lateral direction and the bottom end 15*c* thereof is protuberantly extended so as to be capable of getting close to the contact line 2*a* of the back rollers 2 as far as possible.

In the drafting device as described above, it is important that an arrangement of every component member is intended to make the advance direction of sliver S approximately straight.

The function of aforementioned drafting device is described hereunder.

The sliver S drawn from the can and entering the sliver guide 1 is cross-sectionally compressed gradually by the conical inner wall 12*c* of the guide and fed to the back rollers 2 while being formed into a bundle narrow in width and high in fiber density. At this time, since the outlet 12*a* of the sliver guide 1 is in proximity to the back rollers 2, the sliver S emerging from the outlet 12*a* is fed to the back roller pair 2 so soon that it can not afford to expand cross-sectionally. The sliver S compressed and flattened by the back rollers 2 is delivered to the adjusting guide 11 to be again compressed in narrow width and is fed into the middle roller pair 4. Thus, the sliver S is once reshaped to be narrow in width by the sliver guide 1 before fed to the back roller pair 2, whereby expansion of the fiber bundle after passing the back rollers 2 being controlled to a considerable extent and uneven draft as described in the beginning being suppressed. Such control and suppression are effectively facilitated by provision of an adjusting guide 11 which serves in almost the same way as that of the sliver guide 1. The above effect is further enhanced by an arrangement of the sliver guide outlet 12*a* and the adjusting guide outlet 15 in proximity to the contact line 2*a* of the back rollers, where the sliver S is made smaller in width on said contact line 2*a*. The sliver guide 1 is in extremely long cylindrical shape and, accordingly, permits the fed sliver S to be moderately compressed while passing along the inner wall 12*c* of the guide, preventing individual fibers from hooking. The sliver guide 1 thus elongated makes it possible to feed the sliver S at a position distant from the drafting device and also makes it unnecessary to remove and fix the cradle every time of sliver feeding, differently from the conventional one. The sliver S is easily fed by inserting the sliver-end made finer by rubbing with the operator's fingers into the inlet 12*b*.

Various types of outlets 12*a* for the sliver guide 1 are available as shown in FIGS. 4-*a*, 4-*b* and 4-*c*. As regards geometry of the inner wall 12*c*, it may be a tapered one beginning at the midway of the passageway 12 as shown in FIG. 5, in other words, whatever configuration may be available so far as it permits the sliver S to run smooth and to be compressed widthwise moderately. Further, as shown in FIG. 4-*d*, the purpose may be fulfilled by providing one or more ribs 19 of a certain length along the passageway of sliver S for guiding the sliver S.

As pointed out hereinbefore, the peripheral speeds of the rollers 2, 4 and 5 are different from one another, and the silver is consecutively drafted because of such differences of the peripheral speed among the rollers 2, 4 and 5. Among the circumferential speeds of the rollers 2, 4 and 5, there is established a relation of circumferential speed of back roller 2<circumferential speed of middle roller 4<circumferential speed of front roller 5, and these circumferential speeds are determined appropriately according to the intended draft ratios.

The drafting apparatus illustrated in FIG. 8 will now be described in detail. A top apron 3*a* and a bottom apron 3*b* are attached to the top middle roller 4*a* and bottom middle roller 4*b*, respectively. Each of the aprons 3*a* and 3*b* has an endless belt-like shape, and the top and bottom aprons 3*a* and 3*b* are travelled in the state pressed to each other with rotation of the middle rollers 4*a* and 4*b*, and the bottom apron 3*b* is held by a guide plate 23 of a traverse rod 22 sliding in a guide groove 21*a* of a supporting block 21 and is traversed in the axial direction at a predetermined frequency.

Incidentally, the bottom rollers 2*b*, 4*b* and 5*b* are positively driven by a driving motor (not shown), and the respective bottom rollers 2*b*, 4*b* or 5*b* of all the units are connected through one common shaft or they are connected through a plurality of blocks of shafts, each block connecting rollers of a series of drafting units, for example, ten or fifteen drafting units so that exchange is possible for the respective blocks independently. Blocks of a predetermined number of units are connected to one another through known dismountable joints. Several reserve aprons are attached to the shaft of the bottom middle roller 4*b* of each unit, and after these reserve aprons have been used away, reserve aprons of the subsequent cycle are attached. In order to facilitate the operation of detaching and attaching the shaft for this reserve apron exchanging operation, the shaft for the bottom middle rollers 4*b* is divided for blocks including a predetermined number of drafting units and these blocks are connected to one another.

The traverse apparatus for traversing the bottom apron 3*b* is illustrated in FIGS. 9 through 12.

Figure 12:
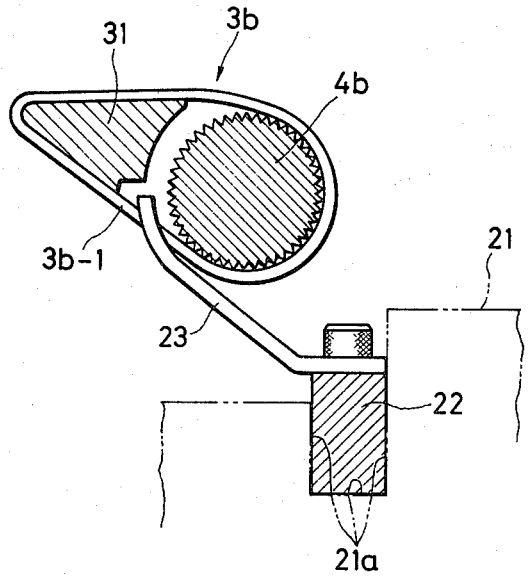

One end of guide plates 23 in a number corresponding to the number of drafting units are secured to the top face of the traverse rod 22 sliding at a predetermined frequency in the guide groove 21*a* of the supporting block 21 arranged along the bottom middle rollers 4*b*, and each guide plate 23 is projected upward at a right angle to the axis of the rod 22 as shown in FIG. 12 and the portion of the guide plate 23 near the top end thereof is extended at least beyond the lower side 3*b*-1 of the bottom apron 3*b* so that the guide plate 23 covers the bottom middle roller 4*b*. In the vicinity of the top end of the guide plate 23, there is formed a concave portion 23*a* having a width larger than the width of the apron 3*b*, and the bottom apron 3*b* is held in the concave portion 23*a* of the guide plate 23 moving with the traverse movement of the traverse rod 22 and the bottom apron 3*b* is traversed in this state.

The traverse speed of the bottom apron 3*b* is very important since it has delicate influences on the physical properties of the spun yarn Y.

Figure 13:
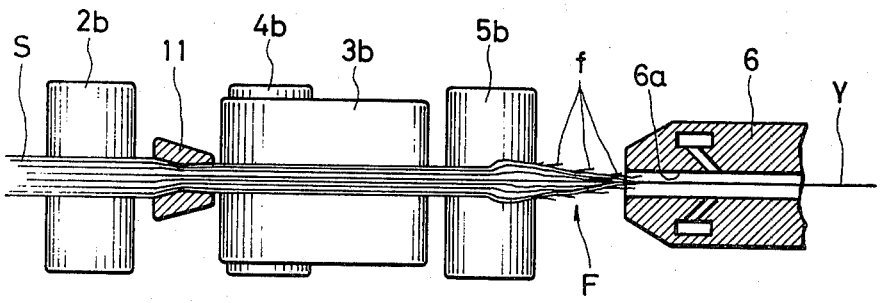
FIGS. 13 and 14 are diagrams illustrating the spinning process.

At the spinning step, as shown in FIG. 13, the sliver is passed through the back rollers, the middle rollers 4 provided with the aprons 3 and the front rollers 5, whereby the sliver is consecutively drafted to a fiber bundle corresponding to one yarn, and the resulting fiber bundle is uniformly twisted by the pnuematic spinning apparatus, whereby a yarn Y is formed. In this consecutive spinning process, from the viewpoint of the stability of the quality of the spun yarn, it is preferred that the locus of advance of the sliver S from the back rollers to the pneumatic spinning apparatus 6 be linear and the locus of advance of the center of the fiber bundle fed out from the nip point of the front rollers be in agreement with the central line of the yarn passing hole 6*a* of the pneumatic spinning apparatus 6.

Figure 14:
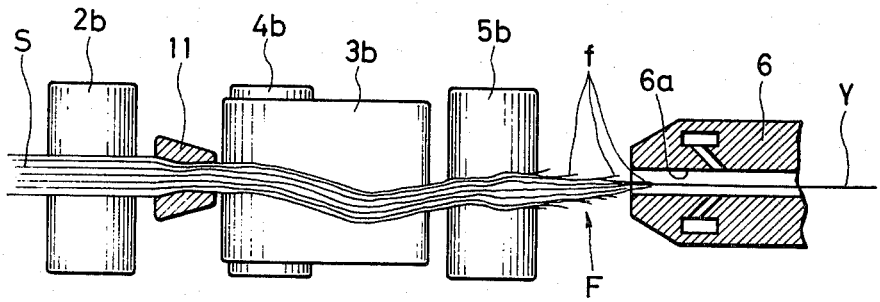

When the traverse speed is too high, as shown in FIG. 14, the sliver S fed out through the back rollers 2 is supplied to the front rollers 5 while meandering in the state deviating from the center of the aprons 3, with the result that uneven drafting is caused. Furthermore, the center of the fiber bundle fed out from the nip point of the front rollers 5 is not in agreement with the central line of the yarn passing hole 6*a* of the pneumatic spinning apparatus 6, and therefore, one end-free fibers f formed in the vicinity of the outer periphery of the fiber bundle F are not uniformly twisted in the yarn and some of them are not gathered in the yarn passing hole 6*a* and fall down as both end-free fibers. As the result, the tenacity of the yarn is reduced and a thin portion is formed in the resulting yarn. Moreover, the fiber density becomes unballanced. These defects are combined together, and the yarn quality is reduced.

Accordingly, the traverse width and traverse speed of the bottom apron in the spinning process should be set so that the physical properties of the spun yarn are not influenced by the traverse movement of the bottom apron.

From experiments made by us, it has been confirmed that when a mixture comprising a polyester and cotton at a polyester/cotton ratio of 65/35 is spun with a spun yarn count of Ne 20 at a spinning speed of about 150 m/min while traversing the bottom apron 3*b* with a traverse width W of 6 to 8 mm per cycle at a traversing speed of 2 to 8 minutes per one cycle, the yarn quality is not influenced by the traverse movement of the bottom apron and wear of the apron can be reduced to ⅓ to ¼ or less.

Since the traverse speed and traverse width W are changed according to the starting material, the spun yarn count, the spinning speed, the drafting ratio and other conditions, it is difficult to set definitively the traverse speed and traverse width. In principle, however, any traverse width and traverse speed may be adopted so far as the supplied sliver S is not caused to meander or deviate between the back roller 2 and the pneumatic spinning apparatus 6 by the traverse movement of the bottom apron 3*b*.

Referring to FIGS. 9 and 10 again, one end of the traverse rod 22 is connected to a joint member 24 such as a ball joint and another joint member 26 is supported on an eccentric shaft 28 of an eccentric cam 27 through a connecting rod 25. The eccentric cam 27 is pivoted on a driving shaft 30 to which the driving power of a driving motor M is transmitted through a reduction gear box 29, and by rotation of the driving shaft 30, the eccentric cam 27 is rotated and the eccentric shaft 28 of the eccentric cam 27 is turned with the driving shaft 30 being as the center. Accordingly, the traverse rod 22 and guide plate 23 are traversed through the joint member 26 connected to the eccentric shaft 28, the connecting rod 25 and the joint member 26, whereby as shown in FIG. 11, the bottom apron 3*b* supported on the concave portion of the guide plate 23 is traversed to the left and right (3*b*-1 and 3*b*-2) in the axial direction.

Figure 8:
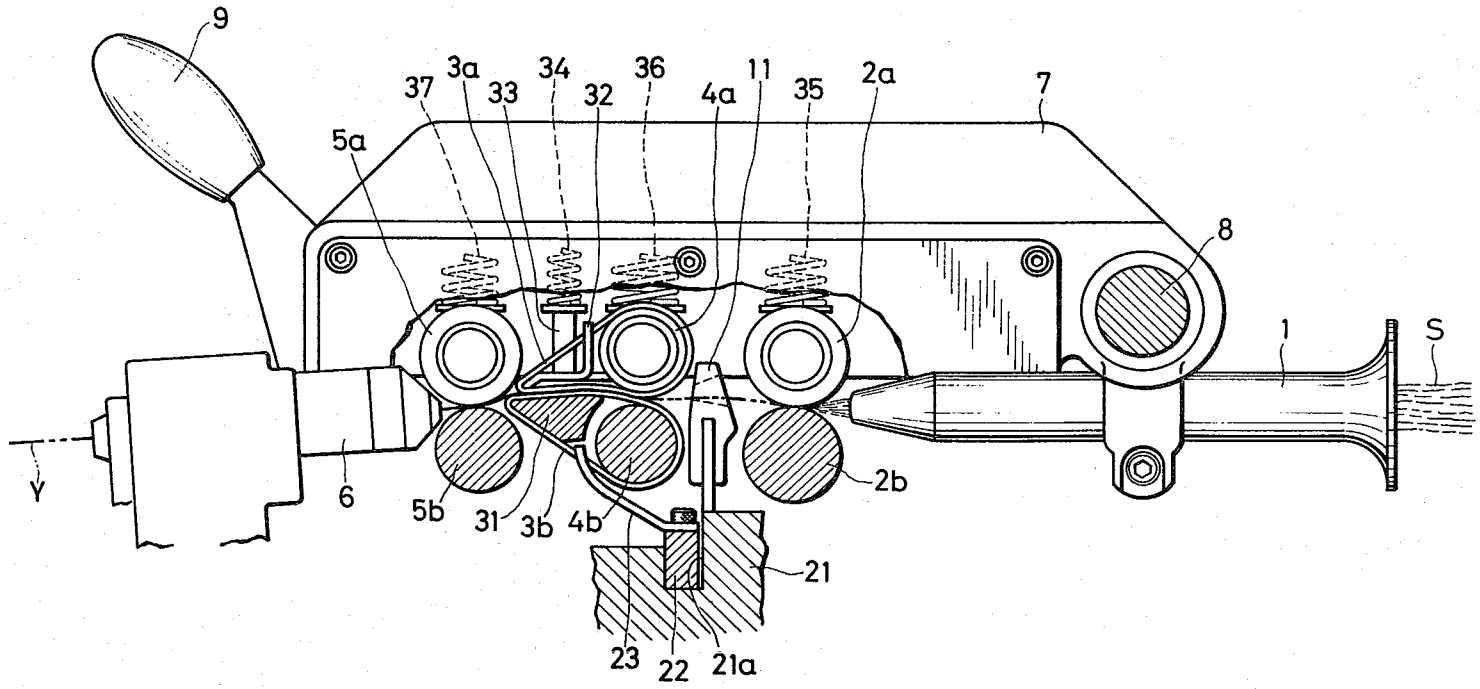
FIG. 8 is a partially cutaway side view of another embodiment of the drafting apparatus.

Referring to FIGS. 1 and 8, the aprons are moved in the state pressed to each other with rotation of the middle rollers 4. The yarn quality is influenced by the pressing position and pressing force of the top apron 3*a* and bottom apron 3*b*. The pressing position of the bottom apron 3*b* is determined by arranging the tenser bar 31 secured by a stationary lever (not shown) on the inner side of the top end of the bottom apron 3*b*, and in order to avoid influences of the air currents in the driving zone including the front rollers, it is preferred that the pressing position of the bottom apron 3*b* be deviated upward by 1.5 to 5 mm from the nip point of the front rollers 5. A cradle 32 is mounted on the inner side of the top end of the top apron 3*a*, and the pressing force of the aprons 3 is determined by urging the cradle 32 by a spring 34 through a pressing pin 33.

Incidentally, the spring 34 is supported substantially at the center of a roller supporting box 7 together with springs 35, 36 and 37 urging other rollers, that is, the top back roller 2*a*, top middle roller 4*a* and top front roller 5*a*, and the roller supporting box 7 is constructed so that it can be opened upward with a stationary shaft 8 being as the fulcrum in the state where the top rollers 2*a*, 4*a* and 5*a* are being supported on the box 7. While the yarn Y is being formed, the box 7 is locked by a locking lever 9, and the pressing pressures of the respective rollers 2, 4 and 5 and the aprons 3 are maintained at levels suitable for formation of spun yarns by the springs 34, 35, 36 and 37.

The operations of the drafting apparatus will now be described.

Referring to FIGS. 1 and 8, the sliver S supplied along the yarn passage is passed through the sliver guide 1 and consecutively drafted by the upper and lower back rollers 2, middle rollers 4 (provided with aprons 3) and front rollers 5 positively rotated in the state pressed to each other, and the resulting fiber bundle corresponding to one spun yarn is fed out from the front rollers 5.

In this consecutive process, when the sliver S is passed through between the top apron 3*a* and the bottom apron 3*b*, the bottom apron 3*b* is held by the guide plate 23 making a traverse movement co-operatively with the traverse rod 22 and is traversed in this state at a predetermined frequency.

Figure 9:
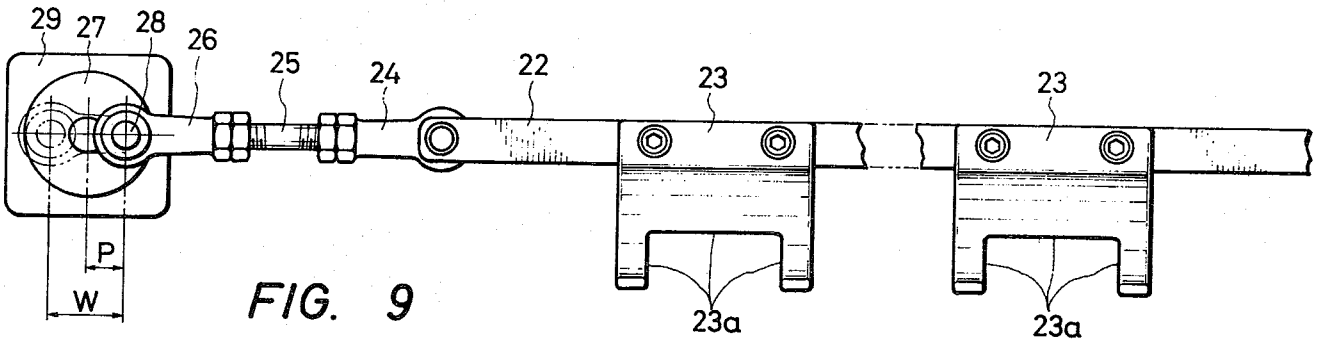
FIGS. 9 and 10 are plan and side views of the traverse apparatus.
Figure 10:
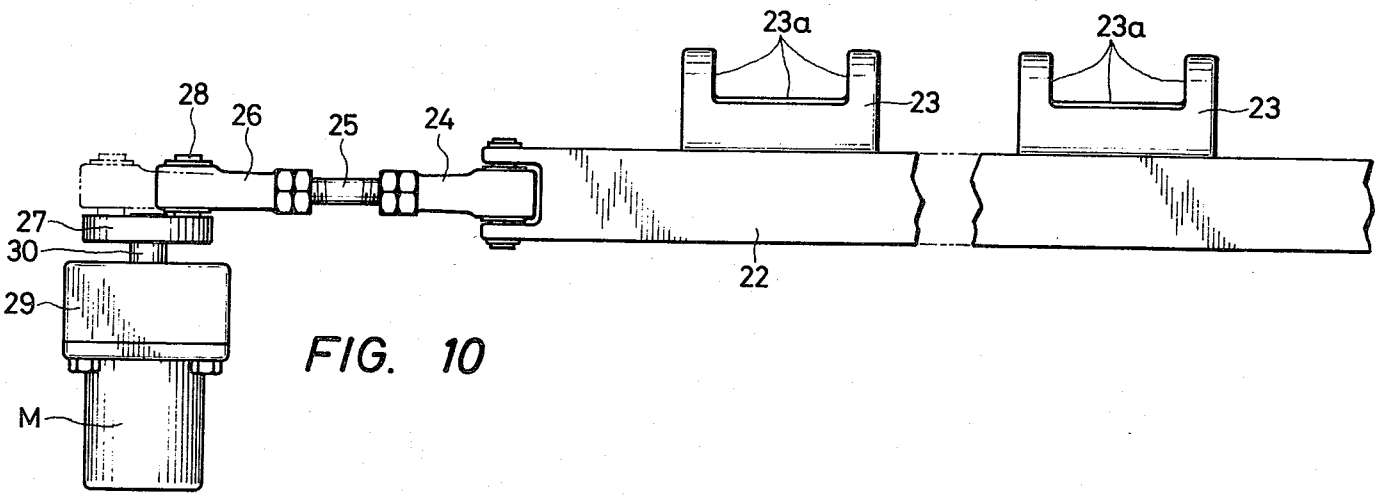
Figure 11:
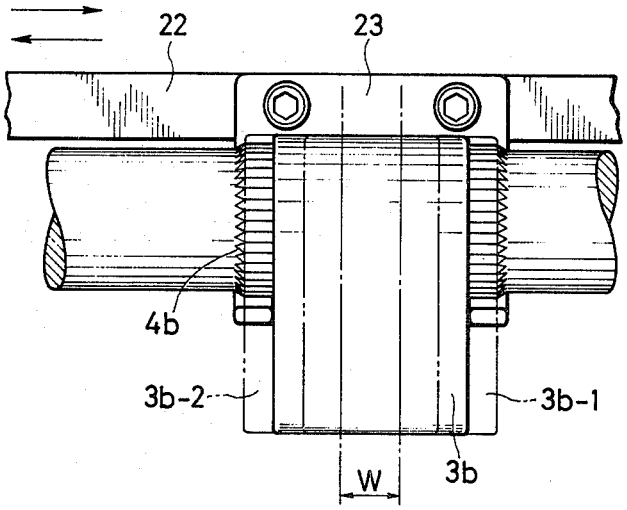
FIGS. 11 and 12 are plan and side views illustrating the state of attachment of guide plates.

As shown in FIGS. 9 and 10, by rotation of the driving shaft 30 to which the driving power of the driving motor M is transmitted through the reduction gear box 29 and also by rotation of the eccentric cam 27 secured to the driving shaft 30, the eccentric shaft 28 projected at a position P deviated from the center of the eccentric cam 27 by ½ of the traverse width is turned and this turning movement of the eccentric shaft 28 is converted to a linear movement of the traverse rod 22 through the joint member 24, connecting rod 25 and joint member 26 connecting the eccentric shaft 28 to the traverse rod 22, whereby the traverse movement of the guide plate 23 is performed.

At this time, the supplied sliver S is brought into contact with the bottom apron 3*b* along the entire traverse width. Accordingly, wearing of the yarn contact surface of the apron is reduced, and the life of the apron becomes several times as long as the life of the apron when it is not traversed.

In principle, the traverse movement may be made on either the top apron 3*a* or the bottom apron 3*b*. However, from the viewpoints of easiness in the apron exchanging operation and simplification of the mechanism and in view of the fact that since the sliver S is travelled while being pressed toward the bottom apron 3*b*, the wear quantity of the bottom group 3*b* is larger than the wear quantity of the top apron 3*a*, it is preferred that the bottom apron 3*b* be traversed. Practically, however, there may be adopted a method in which both the top and bottom aprons 3*a* and 3*b* are simultaneously traversed or they are alternately traversed.

The fiber bundle F corresponding to one spun yarn, which is fed out from the nip point of the front rollers 5, as shown in FIG. 13, is passed through the center of the yarn passing hole 6*a* of the pneumatic spinning apparatus 6 and is twisted by the pneumatic spinning apparatus 6, whereby a yarn Y is formed.

The formed yarn Y is positively taken out through the yarn guide by the take-up roller as described hereinbefore, and is passed through traverse guides, friction rollers and the like of other necessary steps and is then wound on a package.

What is claimed is:

1. A drafting apparatus which comprises a pair each of upper and lower back rollers, apron-provided middle rollers and front rollers arranged in sequence along the advance direction of a sliver to be spun, characterized in that a substantially cylindrical elongated sliver guide having a sliver passageway gradually reducing in diameter thereof along the advance direction of sliver is disposed in front of the back rollers wherein an adjusting guide which provides with a sliver passageway at the top portion thereof and a setting groove at the bottom portion thereof is arranged between the back rollers and the middle rollers, said sliver passageway being formed to have an outlet being laterally narrower than an inlet to form a taper and said setting groove being slidably fitted and secured on a supporting plate.

2. A drafting apparatus which comprises a pair each of upper and lower back rollers, apron-provided middle rollers and front rollers positively rotated along a yarn passage in the state pressed to each other, said three pairs of the rollers are being arranged in sequence, characterized in that said drafting apparatus further includes an apron traversing means comprising a guide plate for traversing one of the aprons having an endless like shape and being attached to the middle rollers, a traverse rod provided with the guide plate at the top thereof, and a supporting block arranged along the bottom middle roller, said traverse rod being slided at a predetermined frequency in a guide groove of the supporting block.

3. A drafting apparatus as claimed in claim 2, wherein said guide plate is projected upward and is extended at least beyond the lower face of the bottom apron so that the guide plate covers the bottom middle roller, and said bottom apron is held in a concave portion of the guide plate to be moved with the traverse movement of the traverse rod.

4. A drafting apparatus as claimed in claim 3, wherein the traverse rod and guide plate are caused to be traversed by the action of a joint member having one end thereof connected to the traverse rod and an end opposite thereto connected to an eccentric cam which is driven by a shaft.

* * * * *